US010704386B2

(12) United States Patent
Pillai

(10) Patent No.: US 10,704,386 B2
(45) Date of Patent: Jul. 7, 2020

(54) WAVE REFLECTION SUPPRESSION IN PULSE MODULATION TELEMETRY

(71) Applicant: Halliburton Energy Services, Inc., Houston, TX (US)

(72) Inventor: Bipin Kumar Pillai, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 8 days.

(21) Appl. No.: 15/536,110

(22) PCT Filed: Jan. 12, 2015

(86) PCT No.: PCT/US2015/011034
§ 371 (c)(1),
(2) Date: Jun. 14, 2017

(87) PCT Pub. No.: WO2016/114752
PCT Pub. Date: Jul. 21, 2016

(65) Prior Publication Data
US 2017/0350243 A1 Dec. 7, 2017

(51) Int. Cl.
*E21B 47/18* (2012.01)
*E21B 7/04* (2006.01)

(52) U.S. Cl.
CPC ..... *E21B 47/18* (2013.01); *E21B 7/04* (2013.01); *E21B 47/182* (2013.01)

(58) Field of Classification Search
CPC ..... E21B 47/18; E21B 7/04; E21B 47/182
USPC ..... 367/83
See application file for complete search history.

(56) References Cited

U.S. PATENT DOCUMENTS 5,859,811 A 1/1999 Miller et al.
5,987,385 A * 11/1999 Varsamis ..... E21B 47/0002 702/6
6,115,113 A 9/2000 Flockencier
6,717,992 B2 4/2004 Cowie et al.
6,741,185 B2 5/2004 Shi et al.
6,925,109 B2 8/2005 Richards et al.
(Continued)

FOREIGN PATENT DOCUMENTS

CN 102200009 A 9/2011
CN 102354501 A 2/2012
(Continued)

OTHER PUBLICATIONS

Canadian Application Serial No. 2970130; Examiner's Letter; dated Apr. 9, 2018, 3 pages.
(Continued)

*Primary Examiner* — Kam Wan Ma
(74) *Attorney, Agent, or Firm* — Gilliam IP PLLC

(57) ABSTRACT

A method including receiving a waveform, identifying the presence of a pulse in the waveform, and subtracting a reflection template from the received waveform when a pulse is present in the waveform to obtain a corrected waveform, is presented. The method may further include reading the corrected waveform using a digital processing protocol and adjusting a drilling parameter according to the reading. A device configured to perform a method as above is also provided. A method as above, further including modifying a drilling parameter in a wellbore based on the reading of a pulse sequence including the waveform is also provided.

20 Claims, 10 Drawing Sheets

(56) References Cited

U.S. PATENT DOCUMENTS

| | | | | |
|---|---|---|---|---|
| 7,099,367 | B2 | 8/2006 | Richards et al. | |
| 7,177,341 | B2 | 2/2007 | McCorkle | |
| 7,230,980 | B2 | 6/2007 | Langford et al. | |
| 7,606,503 | B2 | 10/2009 | Ikushima et al. | |
| 7,733,937 | B2 | 6/2010 | Arslan | |
| 7,868,815 | B2 | 1/2011 | Fukagawa et al. | |
| 8,385,187 | B2 | 2/2013 | Flury et al. | |
| 8,660,206 | B2 | 2/2014 | Kohno | |
| 10,060,248 | B2 * | 8/2018 | Rodney | E21B 44/00 |
| 2003/0016164 | A1 | 1/2003 | Finke et al. | |
| 2006/0140249 | A1 | 6/2006 | Kohno | |
| 2008/0007421 | A1 * | 1/2008 | Liu | G01V 11/002 340/853.3 |
| 2009/0146836 | A1 * | 6/2009 | Santoso | E21B 47/12 340/854.4 |
| 2009/0259404 | A1 | 10/2009 | Hirabayashi et al. | |
| 2010/0020864 | A1 | 1/2010 | Matsuo et al. | |
| 2010/0188253 | A1 * | 7/2010 | Shearer | E21B 47/18 340/853.3 |
| 2011/0264398 | A1 * | 10/2011 | Niewczas | G01D 3/0365 702/130 |
| 2012/0235677 | A1 * | 9/2012 | Blanz | G01N 24/081 324/303 |
| 2013/0116971 | A1 | 5/2013 | Retkowski et al. | |
| 2013/0154845 | A1 * | 6/2013 | Brooks | E21B 47/18 340/854.3 |
| 2015/0014521 | A1 * | 1/2015 | Barfoot | E21B 47/123 250/261 |
| 2015/0032379 | A1 * | 1/2015 | Campbell | G01V 1/42 702/14 |
| 2015/0253447 | A1 * | 9/2015 | Mukhopadhyay | G01V 1/24 702/6 |
| 2015/0354333 | A1 * | 12/2015 | Kasevich | E21B 43/24 166/247 |
| 2015/0377765 | A1 * | 12/2015 | Chilukuri | G01N 17/04 356/73.1 |
| 2017/0058660 | A1 * | 3/2017 | Hunter | E21B 47/0005 |

FOREIGN PATENT DOCUMENTS

| | | | |
|---|---|---|---|
| EP | 1114334 | B1 | 11/2004 |
| GB | 2361789 | A | 10/2001 |
| GB | 2376858 | A | 12/2002 |
| WO | 2001095508 | A2 | 12/2001 |
| WO | 2014159839 | A1 | 10/2014 |

OTHER PUBLICATIONS

International Search Report and Written Opinion for PCT/US2015/011034 dated Sep. 11, 2015.

Jin et al., Time reversal enabled elastic wave data communications using sensor arrays, Proceedings of Meetings on Acoustics, Published Jan. 29, 2014, vol. 20, 2013, Acoustical Society of America through the American Institute of Physics.

GCC Application Serial No. 30650; First Examination Report, dated Dec. 2, 2018, 5 pages.

CN Application No. 201580071537.X, First Office Action dated Mar. 12, 2020, 15 pages including English translation.

CN Application No. 201580071537X, Search Report dated Mar. 12, 2020, 4 pages including English translation.

Norwegian Application Serial No. 20170937; Office Action; dated Feb. 5, 2020, 7 pages.

* cited by examiner

WAVE REFLECTION SUPPRESSION IN PULSE MODULATION TELEMETRY

BACKGROUND

In the field of oil and gas exploration and extraction, pressure sensors are customarily used at the surface for reading data generated by a pulse generator (or a pulser) located downhole. The data travels through the drilling mud along the wellbore, typically in the form of short pulses providing a binary encoded signal, to the surface. Some of the telemetry schemes used for transmitting data from near the drill tool in a wellbore to the surface include Pulse Position Modulation (PPM) and Pulse Width Modulation (PWM). These modulation techniques rely on sending a sequence of acoustic pulses encoding data to be telemetrically transmitted to the surface through the drilling mud in a mud flow. In a PPM scheme, the position of a pulse in a given time slot within a selected packet of time slots indicates a value for a symbol. Some configurations include a differential PPM (DPPM) scheme, in which the location of a current pulse is determined in relation to the previous pulse, rather than within a specified time window. In a PWM scheme, the length of a sequence of consecutive pulses within the packet is correlated to a value for the symbol. The closer in time that pulses can be placed with respect to each other, the more data can be sent in the same amount of time. This is especially desirable when the amount of data transmitted to the surface is exceedingly large (e.g., image data files).

In some instances, this data can be distorted and attenuated during this process. For example, acoustic pulses can be distorted due to dispersion and attenuation effects as they travel along the wellbore. Acoustic pulses also can be reflected at various points of the mud flow system and create one or more echoes or reflections in a pulse sequence. Pulse reflections may occur, for example, at the surface pumps in a drilling system, or at any bend in the plumbing associated with a mud flow, in the drilling system. More generally, a plurality of acoustic pulses originating from the same signal pulse at a source may follow multiple paths and arrive at a sensor at slightly different time, thereby interfering with other 'true' signal pulses arriving at the sensor. Spurious 'echo' and multi-path interference effects and possibly others can negatively impact the quality of the information content of the pulse sequence, increasing Bit-Error-Rate (BER), as the signal-to-noise ratio (SNR) is reduced. For example, a reflected pulse may overlap with a subsequent signal pulse, distorting the transmitted message in a phenomenon known as inter-symbol-interference (ISI). Therefore, a minimum time is typically set between pulses so that the pulse reflection does not affect the following pulse. This minimum pulse time (MPT) determines the maximum data rate that can be transmitted to the surface in a mud pulse telemetry application.

Attempts to resolve the pulse 'echo' problem include increasing the time lapse between successive pulses in the signal to identify pulse 'echoes' from a widely spread pulse sequence, or letting the pulse echoes die off before the next signal pulse arrives. Other approaches include a "training pulse sequence" transmitted at pre-selected times. A training pulse sequence is a pre-selected sequence of pulses known to the transmitting party and to the receiving party. Knowledge of the ideal pulse sequence and comparison with the received pulse sequence enables a data processor to perform the appropriate adjustments to received signals. However, utilizing training pulse sequences as means to reduce BER may not be reasonable, as it has an undesirable time cost associated with it since real operations have to be off-line while the training pulse is run. Some of the above approaches limit the number of pulses that can be placed on a given time interval, thereby introducing a lower limit to the time length of a data frame and an upper limit to the data transmission rate. This compromise is undesirable in conditions where large amounts of data are transmitted in real-time logging while drilling (LWD) applications.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
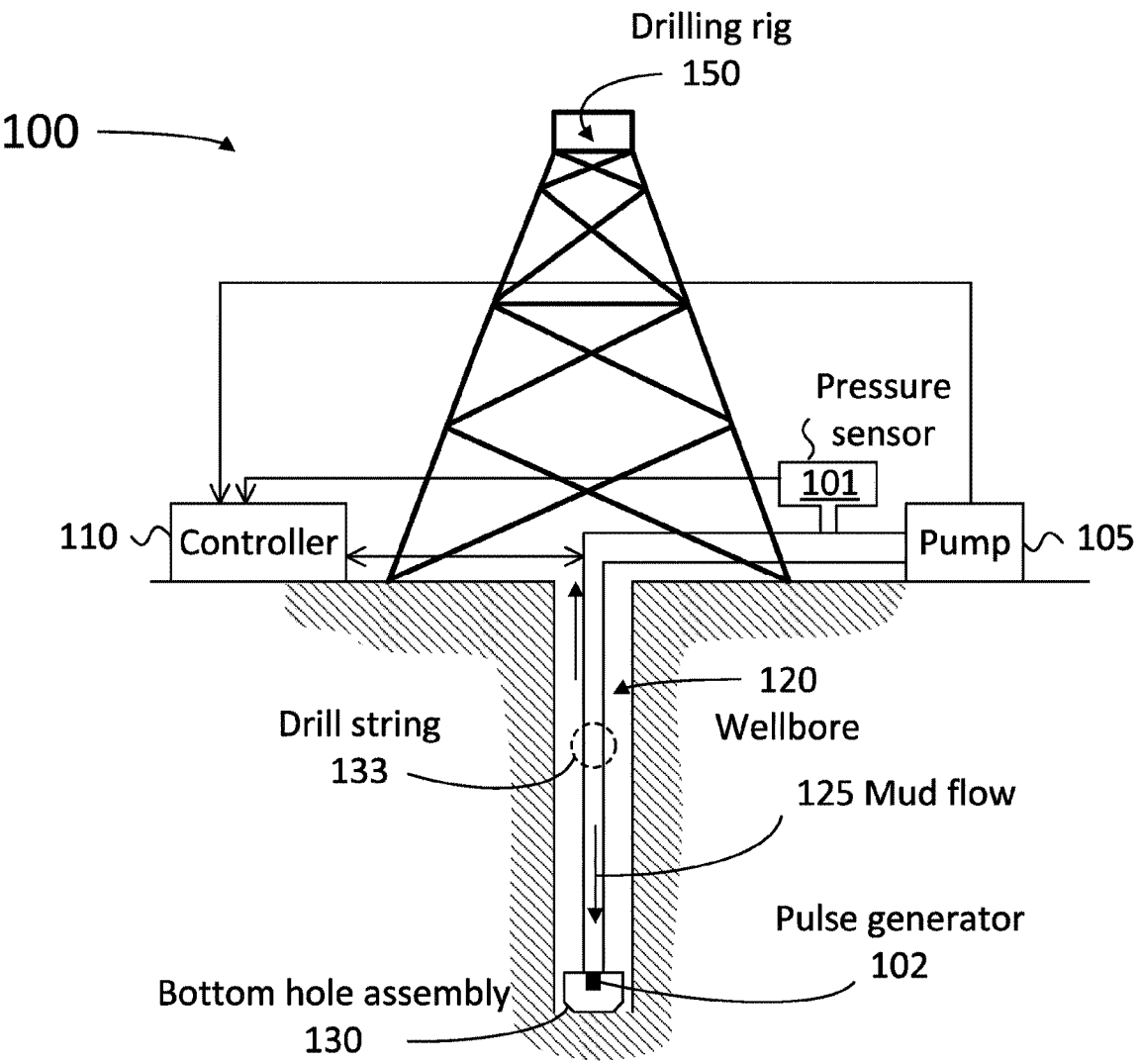
FIG. 1 illustrates a drilling system using a pressure sensor configured to suppress pulse reflections in a pulse modulation telemetry configuration, according to some embodiments.

The present disclosure relates to methods and devices for telemetry schemes used in oil and gas exploration and extraction and, more particularly, to methods and devices for wave reflection suppression in pulse modulation telemetry. More generally, embodiments disclosed herein are directed to suppression of multi-path interference in data communication schemes using signals including a time sequence of pulses in the oil and gas industry. More generally, methods and systems as disclosed herein may be used in any industrial application where signals and data transmission may be hampered by undue reflections of the signal pulses, regardless of the type of wave phenomena used, and the transmission medium. For example, a telemetry signaling scheme as disclosed herein may be used in systems where low power usage is desirable. For example, some embodiments consistent with the present disclosure may include fiber optics, electromagnetic and wireless infrared communications.

Systems and methods for suppressing pulse reflections in pulse modulation telemetry are provided. In some embodiments, the present disclosure includes a method that includes receiving a waveform, identifying the presence of a pulse in the waveform, and subtracting a reflection template from the received waveform when a pulse is present in the waveform to obtain a corrected waveform. The method may further include reading the corrected waveform using a digital processing protocol and adjusting a drilling parameter according to the reading.

An example of a device consistent with embodiments herein includes a memory circuit for storing commands, and a processor circuit configured to execute the commands. When the processor circuit executes the commands, it causes the device to receive a waveform, to identify the presence of a pulse in the received waveform, and to subtract a reflection template from the received waveform when a pulse is present in the waveform, to obtain a "corrected waveform." A waveform as disclosed herein is a temporal trace of values that may be associated to a downhole sensor measurement, such as formation sensor or a pressure sensor as disclosed herein. Accordingly, a "corrected waveform" is the temporal trace where a pulse reflection has been removed. Thus, the "corrected waveform" includes the true signal intended for the surface acoustic transducer or the pressure sensor. A waveform according to some embodiments may include a sequence of acoustic pulses generated by a pulse generator. The pulses may at least partially encode a symbol in a message transmitted between the pulse generator and a pressure sensor in a drill system, the encoding formed according to a digital signal scheme such as PPM or DPPM. The memory circuit includes a processor circuit that causes the device to read the corrected waveform using a digital processing protocol, and to send a command for a downhole tool to adjust a drilling parameter based on the reading of the corrected waveform. More specifically, the downhole tool may be, for example, a drilling tool.

An example of a method consistent with embodiments disclosed herein includes identifying intervals in a received waveform using a pulse template, recovering the received waveform when a valid interval is identified in the received waveform, and performing a weighted average summation on a plurality of received waveforms. The received waveform may be a sequence of acoustic pulses encoding data to be telemetrically transmitted in a drill system for oil and gas exploration and extraction. A valid interval is an interval between two adjacent signal pulses. The method may further include obtaining a waveform template from the weighted average, the waveform template including a signal pulse and a reflection pulse. The waveform template may be used as a prototype for comparison of newly received waveforms in the telemetry transmission. The method further includes extracting a reflection template from the waveform template, reading a pulse sequence from an acoustic transducer using the reflection template, and modifying a drilling parameter, or an operational parameter in a wellbore based on the reading of the pulse sequence. A reflection template may be used as a prototype for suppressing reflection pulses in the newly received waveforms. In some embodiments, the reflection template may be stored in a computer system, and updated periodically as the drilling operation proceeds forward.

FIG. 1 illustrates a drilling system 100 using a pressure sensor 101 configured to suppress pulse reflections in pulse modulation telemetry, according to the disclosure herein. More specifically, pressure sensor 101 is configured to measure pressure fluctuations at the surface and use this measurement to detect true signal pulses and suppress pulse reflections. Drill system 100 may be a logging while drilling (LWD) system or measurement while drilling (MWD), as is well known in the oil and gas industry. A pump 105 maintains mud flow 125 down a drill string 133. A drill string 133 couples a bottom hole assembly 130 with equipment on the surface, such as pump 105 and pressure sensor 101, as well as any other necessary equipment. Bottom hole assembly 130 includes a drilling tool, to form wellbore 120. The tools are supported by drilling rig 150. A controller 110 is electrically and/or mechanically coupled to pressure sensor 101 and to pump 105. Accordingly, pressure signals generated by pulse generator 102 are detected by pressure sensor 101 at the surface. Controller 110 may include a computer system configured to receive data from and transmit commands to pulse generator 102. Optionally, some embodiments include a downhole acoustic (or pressure) sensor to detect commands sent from the surface (i.e., from controller 105). These "downlinks" are pressure pulses generated at the surface (e.g., by a surface pulse generator) and detected by the downhole pressure sensor.

Pulse generator 102, which may be mounted as part of the bottom hole assembly 130 as shown in FIG. 1, is configured to transmit signals to the surface with information related to the drill process. In some embodiments, the information transmitted to the surface may be related to wellbore conditions, downhole environment (such as pressure, temperature, and other characteristics of the oil and or gas or drilling fluid). Messages created by pulse generator 102 may be digitally encoded sequences of acoustic pulses transmitted through mud flow 125 and read by pressure sensor 101. Accordingly, a plurality of digital signal modulation schemes may be used to transmit messages between pulse generator 102 and pressure sensor 101, such as PPM and DPPM schemes. As a response to the messages transmitted between pressure sensor 101 and pulse generator 102, controller 110 may adjust a drilling parameter in bottom hole assembly 130. Drilling parameters include rotational speed and orientation of bottom hole assembly 130. In some embodiments, drilling parameters may also include a pressure and a flow speed of mud flow 125. For example, a drilling speed may be increased, reduced, or stopped by controller 110, based on messages received from pulse generator 102. This may be the case when the bottom hole assembly 130 encounters a solid rock formation, or a fracture, or a water rich reservoir during the drill operation. Moreover, in some embodiments, controller 110 may cause bottom hole assembly 130 to proceed drilling in a different direction. For example, in some embodiments bottom hole assembly 130 may cause drill tool to shift from a vertical drilling (as shown in FIG. 1) to a horizontal or almost horizontal drilling direction. While a drill tool shift depends on the specific formation being explored or exploited, horizontal drilling is desirable to increase wellbore extraction when the formation of interest is mostly a horizontal (or close to horizontal) bed. In some embodiments, adjusting the drilling parameter may include adjusting mud flow 125. In some embodiments mud flow 125 goes through bottom hole assembly 130, thus providing lubrication and debris drainage for the tool. For example, mud flow 125 may be increased or reduced, or the pressure exerted by pump 105 may be increased or reduced. Moreover, in some embodiments adjusting the drilling parameter may include adding chemicals and other additives mud flow 125, or removing additives from mud flow 125. In some instances, these adjustments may include increasing the weight, viscosity, density, or other physical parameters of the mud. Accordingly, some embodiments include automated inclusion of the additives to mud flow 125 at the surface. Further according to some embodiments, staff at the surface may include additives in mud flow 125 according to the messages transmitted between pulse generator 102 and pressure sensor 101.

In some embodiments consistent with the present disclosure, the information flow can occur from the surface to bottom hole assembly 130. Accordingly, acoustic pulses may be generated by a pulse generator at the surface and received at the downhole by a pressure sensor in the bottom hole assembly. In some embodiments, the data transmission may include downlink signals using electro-magnetic pulses in a DPPM scheme.

Figure 2A:
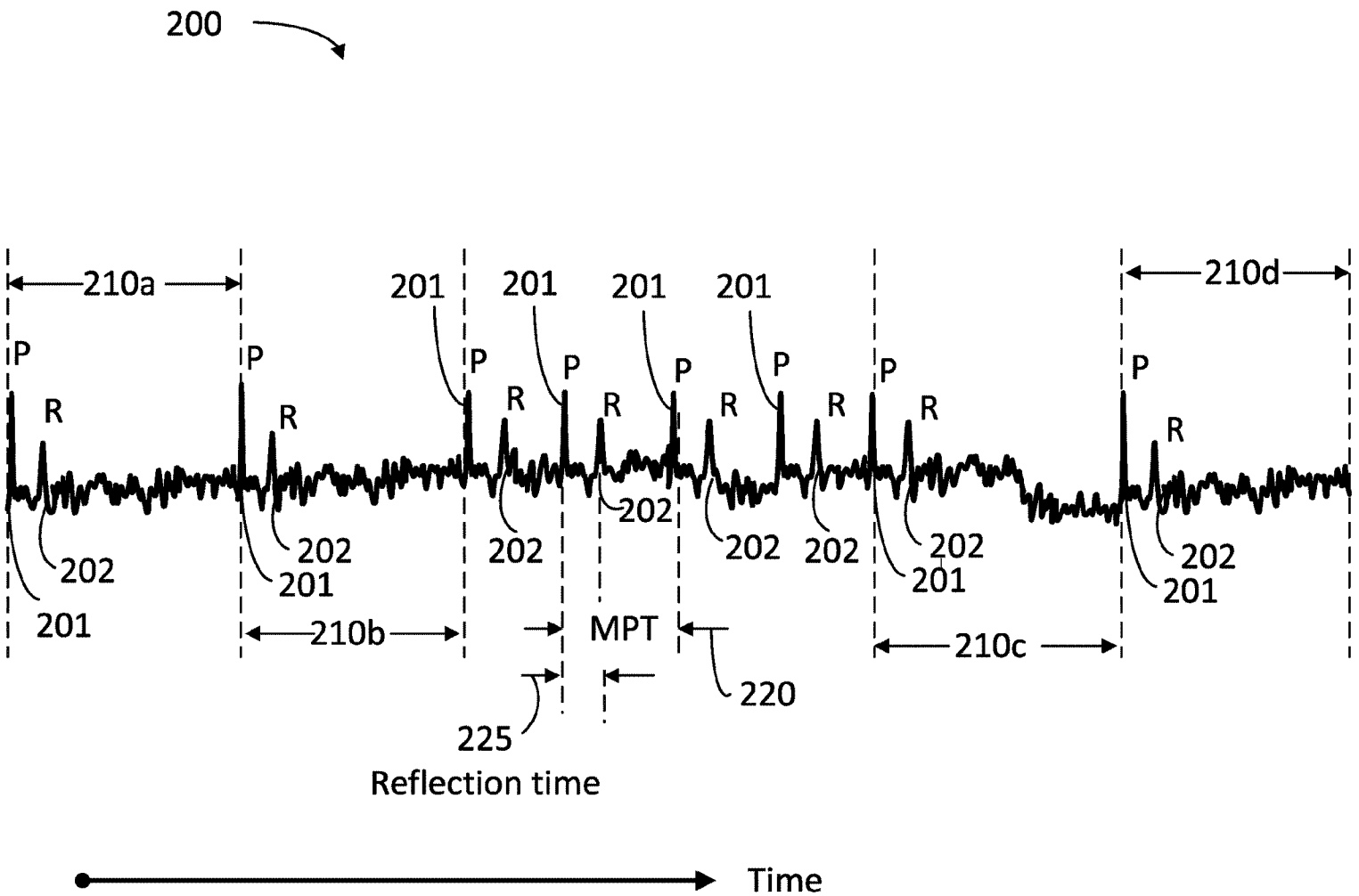
FIG. 2A illustrates a pulse sequence including signal pulses and reflection pulses, according to some embodiments.

FIG. 2A illustrates a pulse sequence 200 including signal pulses 201 (which correspond to the P notations on FIG. 2A) and reflection pulses 202 (which correspond to the R notations on FIG. 2A) spaced over long time interval waveforms 210*a*, 210*b*, 210*c*, and 210*d*, (collectively referred to hereinafter as waveforms 210) and minimum pulse time (MPT) interval waveforms 220, according to some embodiments. More specifically, MPT interval waveforms 220 span the smallest time between two signal pulses 201. A DPPM scheme as used in some embodiments includes encoding a symbol value 'x' in a time interval 'ΔT' between signal pulses. Accordingly, in some embodiments the time interval 'ΔT' may be obtained by applying steps described mathematically in the following equation:

$$\Delta T = \mathrm{MPT} + x \cdot \delta t \quad (1)$$

Where δt is a 'chip width,' or a time lapse expected to include the duration of a signal pulse. Accordingly, in Eq. 1 the value of MPT and the value of δt are constants determined by the type and quality of hardware used to implement the DPPM scheme. In some embodiments, MPT may be 500 ms while δt is 50 ms. Without limitation, in some embodiments MPT is longer than δt.

Embodiments using 4 bits per symbol ('x'=0, up to $2^4$=16, in Eq. 1) there can be up to 16 different interval lengths possible in a packet. For example, when data value is zero (x=0), then the time interval between signal pulses is: ΔT=MPT (cf. Eq. 1). When the data value is one ('x'=1), then the time interval is: ΔT=MPT+δt (cf. Eq. 1). And when x=16 the time interval between two signal pulses is: ΔT=MPT+16·δt (cf. Eq. 1). In some embodiments, the first interval of a packet (e.g., any one of waveforms 210) is purposely made larger than the possible 16 intervals. Without limitation, a packet currently may include a minimum of 4 interval waveforms 220 and up to 18 interval waveforms 220, or even more. In some embodiments, the packet header is the first (long) interval (e.g., waveform 210). In some embodiments, a packet header may include more than one waveform 210.

Accordingly, one or more interval waveforms 220 may occur between long time interval 210*c* and 210*d*. In that regard, long time interval waveforms 210 may include header information a data packet including a plurality of interval waveforms 220, and forming the message transmitted between pulse generator 102 and pressure sensor 101. In FIG. 2A and throughout the present disclosure, the horizontal axis (abscissa) represents the progression of time, in arbitrary units, from left to right. Indeed, reflection pulses 'R' arrive to the detector at a later time relative to signal pulses 'P'. In FIG. 2A and throughout the present disclosure, the vertical axis (ordinate) represents a signal amplitude, in arbitrary units. Without limitation, the signal amplitude is the output of a detector in pressure sensor 101 or in pulse generator 102, which may be an electrical signal such as a voltage (e.g., in Volts) or a current (e.g., in milli-Amperes, mA). While FIG. 2A illustrates only one reflection pulse 202 for each signal pulse 201, embodiments consistent with the present disclosure may include multiple echoes or multiple reflection pulses 202 associated with a signal pulse 201. Such may be the case, for example, when multi-path interference occurs in drill system 100.

Reflection pulses 202 follow signal pulses 201 after a reflection time 225. Reflection pulses 202 may occur at the pump 105, or at any bend of the plumbing used to deliver mud flow 125 (cf. FIG. 1). These bends are typically located close to the surface end of the drill string 133. More generally, reflections can also occur at the drill bit or anywhere in drill string 133 when there is an internal diameter change or a material change. While FIG. 2A shows reflection pulses 202 having a positive amplitude (equal phase relative to signal pulses 201), also disclosed herein are reflection pulses 202 having a negative amplitude (opposite phase relative to signal pulses 201). More generally, the phase relation between signal pulses 201 and reflection pulses 202 may be arbitrary, but substantially constant for at least a plurality of time cycles of signal packets. The shape/duration/amplitude of reflected pulse 202 may be significantly different from the shape/duration/amplitude of signal pulse 201. There may be even more than one reflection pulse 202 following signal pulse 201. In some embodiments, when reflection pulse 202 is within one of waveforms 210, it is possible to reconstruct signal pulse 201 according to methods disclosed herein.

With PPM, data is transmitted between pulse generator 102 and pressure sensor 101 as a packet (which is a sequence of pulses). One of the ways to mark the start of a packet is to have the first interval longer than the rest of the intervals. Accordingly, there may be a plurality of intervals 210*a-d*, in the packet, that are long enough in duration to include a signal pulse 201 and its corresponding surface reflection, reflection pulse 202. In some embodiments, it is desirable that intervals 210*a-d* include a single signal pulse 201 and at least one reflection pulse 202. Accordingly, some embodiments may include intervals 210 having a plurality of reflection pulses 202 stemming from a single signal pulse 201. In some embodiments, as illustrated in FIG. 2A, interval 220 is longer than reflection time 225. In some embodiments, interval 220 may be similar to or even smaller than reflection time 225. As a result, methods and systems consistent with the present disclosure may reduce error in the signal detected from pulse sequence 200 even when interval 220 is shorter than reflection time 225. Thus, embodiments consistent with the present disclosure may substantially increase data rate in a LWD configuration (cf. FIG. 1).

Figure 2B:
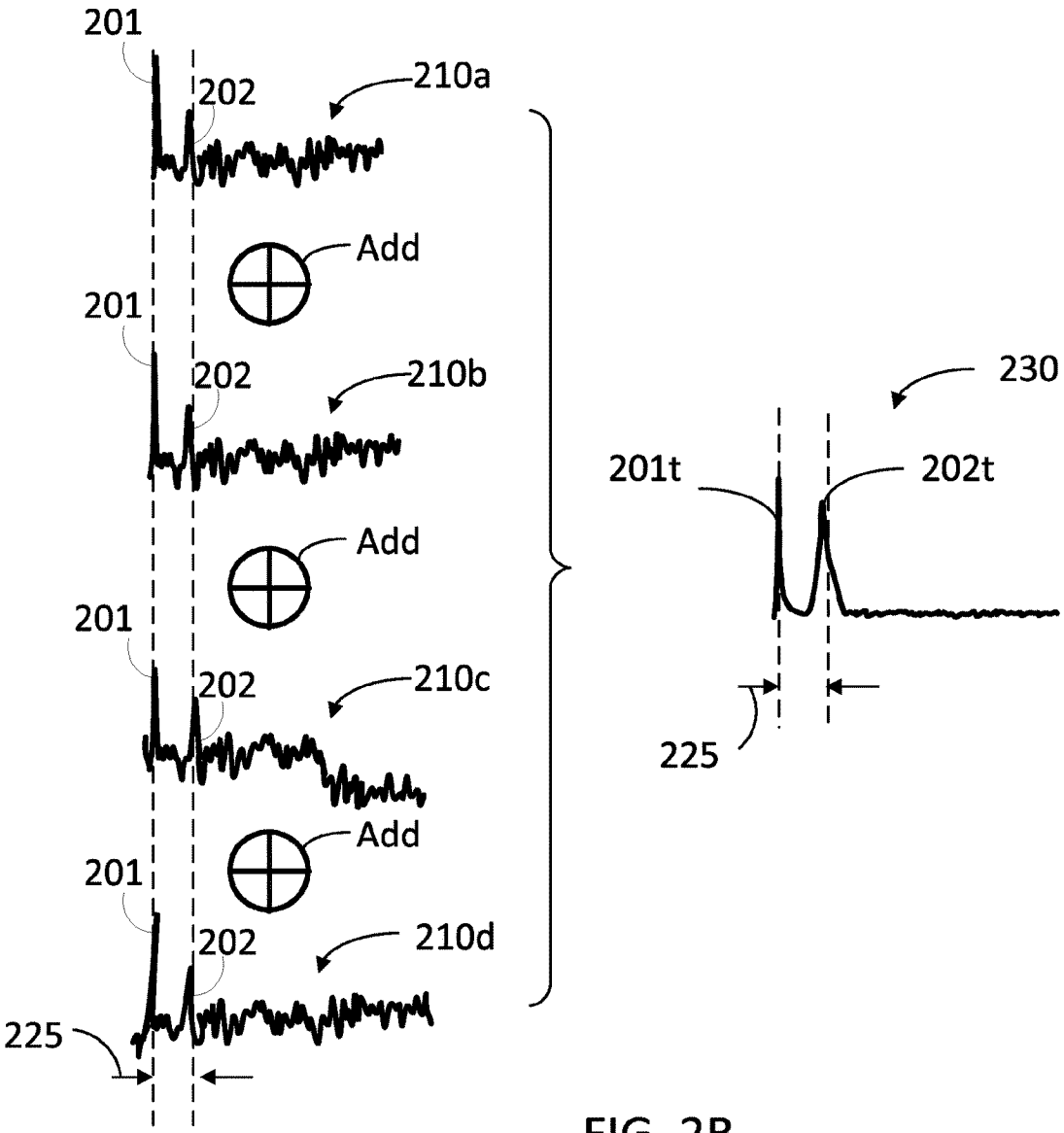
FIG. 2B illustrates averaging a plurality of waveforms to obtain a reflection template, according to some embodiments.

FIG. 2B illustrates averaging the plurality of long time interval waveforms 210 to obtain a waveform template 230 in accordance with the methods disclosed herein. Waveform template 230 includes a signal template 201*t* and a reflection template 202*t*. In FIG. 2B, waveforms 210*a-d* are successfully detected waveforms that are long enough in duration so as to include a signal pulse 201 and at least the most significant reflection pulse 202 (cf. FIG. 2A). The most significant reflection pulse may be the first reflection pulse, which is typically the strongest, and in some instances may be the only reflection pulse following a signal pulse. Also, the time length of waveforms 210*a-d* is short enough to include a single signal pulse 201 and its reflection pulse 202. In this manner, it is clear from the traces that each one of reflection pulses 202 in waveforms 210*a-d* is associated with one of signal pulses 201. Waveform template 230 is the result of time-averaging waveforms 210*a-d*. Accordingly, the signal-to-noise ratio (SNR) in waveform template 230 is higher than on each of waveforms 210*a-d*.

In some embodiments, FIG. 2B shows a weighted average according to the desired relevance of each of waveforms 210 on waveform template 230 in accordance with the methods disclosed herein. For example, some embodiments may give a greater weight to waveform 210*d*, which is more recent, than say, to waveform 210*a*. Accordingly, methods as disclosed herein dynamically adjust to changes in the characteristics of signal pulse 201 and pulse reflection 202 over time by performing a weighted averaging of waveforms 210. Waveform template 230 ($Wav_{template}$) may cancel reflection pulses even for waveforms where interval 220 is similar to or smaller than reflection time 225. Mathematically, embodiments consistent with FIG. 2B may include the following operation:

$$Wav_{template} = \sum_{n} a_n \cdot Wav_n \tag{2}$$

In Eq. (2) the integer value 'n' indicates each of the plurality of waveforms 210 ($Wav_n$). The value of 'n' is not limiting of the scope of embodiments disclosed herein. In that regard, the value of 'n' may be determined according to the drilling conditions and the data transmission speed. If drilling conditions change often, a smaller 'n' may be required for faster adaptation. However, if the 'n' is too small, the SNR may be lower. Similarly, under faster data transmission speeds, the intervals will be closer to each other and may require a higher 'n' to align with changes in the drilling conditions. For example, in some embodiments a lower value of 'n' such as ten (10) or even less may be used for a drill system in which the drilling condition change very often. In some configurations where drilling conditions are stable but the noise level is high, the value of 'n' may be larger, such as twenty (20), thirty (30), or even more. The weighting coefficients '$a_n$' may be normalized coefficients indicating the weight assigned to each of waveforms 210 in waveform template 230. For example, in FIG. 2B, n=4 and $a_1$, associated with waveform 210*a* ($Wav_1$, in Eq. 2) may be smaller than $a_2$, associated with waveform 210*b* ($Wav_2$, in Eq. 2). Likewise, in the embodiments shown in FIGS. 2A-2B the value of $a_3$, associated with waveform 210*c* ($Wav_3$, in Eq. 2) may be larger than $a_2$. And the value of a4, associated with waveform 210*d* ($Wav_4$, in Eq. 2) may be larger than $a_3$.

In pulse telemetry applications, the first signal waveform in a pulse sequence including a packet or payload typically involves one or more long time intervals 210 to allow for packet synchronization. In long time intervals 210, a reflection pulse is easily identified from a signal pulse. For example, the reflection pulse could be a replica of the signal pulse with a somewhat reduced amplitude. Also, the reflection pulse may be identified by showing at the same time delay relative to the stronger signal pulse over more than one of long time interval waveforms 210. Thus, in some embodiments disclosed herein a plurality of long time intervals including at least one reflection pulse may be stored in a memory circuit and averaged, to form the reflection template. A time average effectively removes random noise in the signal, and provides an accurate representation of the reflection pulse, which can then be subtracted from the received waveform to obtain the signal.

Figure 3:
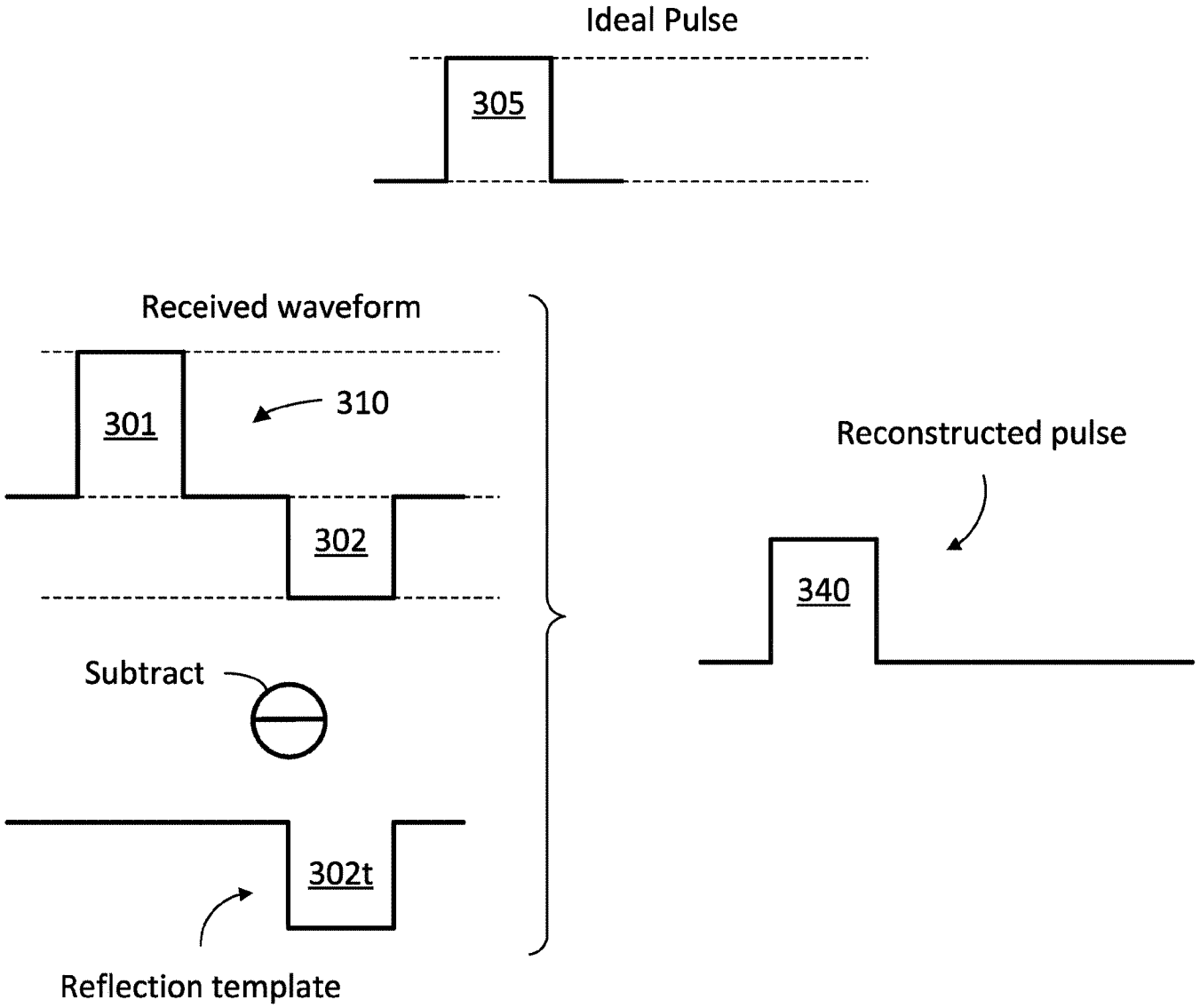
FIG. 3 illustrates a reconstructed pulse resulting from subtracting a reflection template from a received waveform, according to some embodiments.

FIG. 3 illustrates a reconstructed pulse 340 ($Rec_{pulse}$) in accordance with the methods disclosed herein that results from subtracting a reflection template 302*t* ($Ref_{template}$) from a received waveform 310, according to some embodiments. An ideal pulse 305 in the signal produces a received waveform 310 ($Wav_{received}$). Received waveform 310 includes a signal pulse 301 and a reflection pulse 302. Notice that, without loss of generality, reflection pulse 302 and reflection template 302*t* have opposite phase to signal pulse 301. The specific shape of signal pulse 301 as a square waveform with a flat top portion is shown for illustration purposes only. It is understood that, more generally, signal pulse 301 may have a round shape, such as in a Lorentzian peak, a Gaussian peak, or any other response signal produced by pressure sensor 101 or pulse generator 102. A subtraction of reflection template 302*t* from received waveform 310 produces reconstructed pulse 340. Note that reconstructed pulse 340 is similar to ideal pulse 305, as desired. Mathematically, embodiments consistent with FIG. 3 may include the following operation:

$$Rec_{pulse}=Wav_{received}-Ref_{template} \tag{3}$$

Figure 4A:
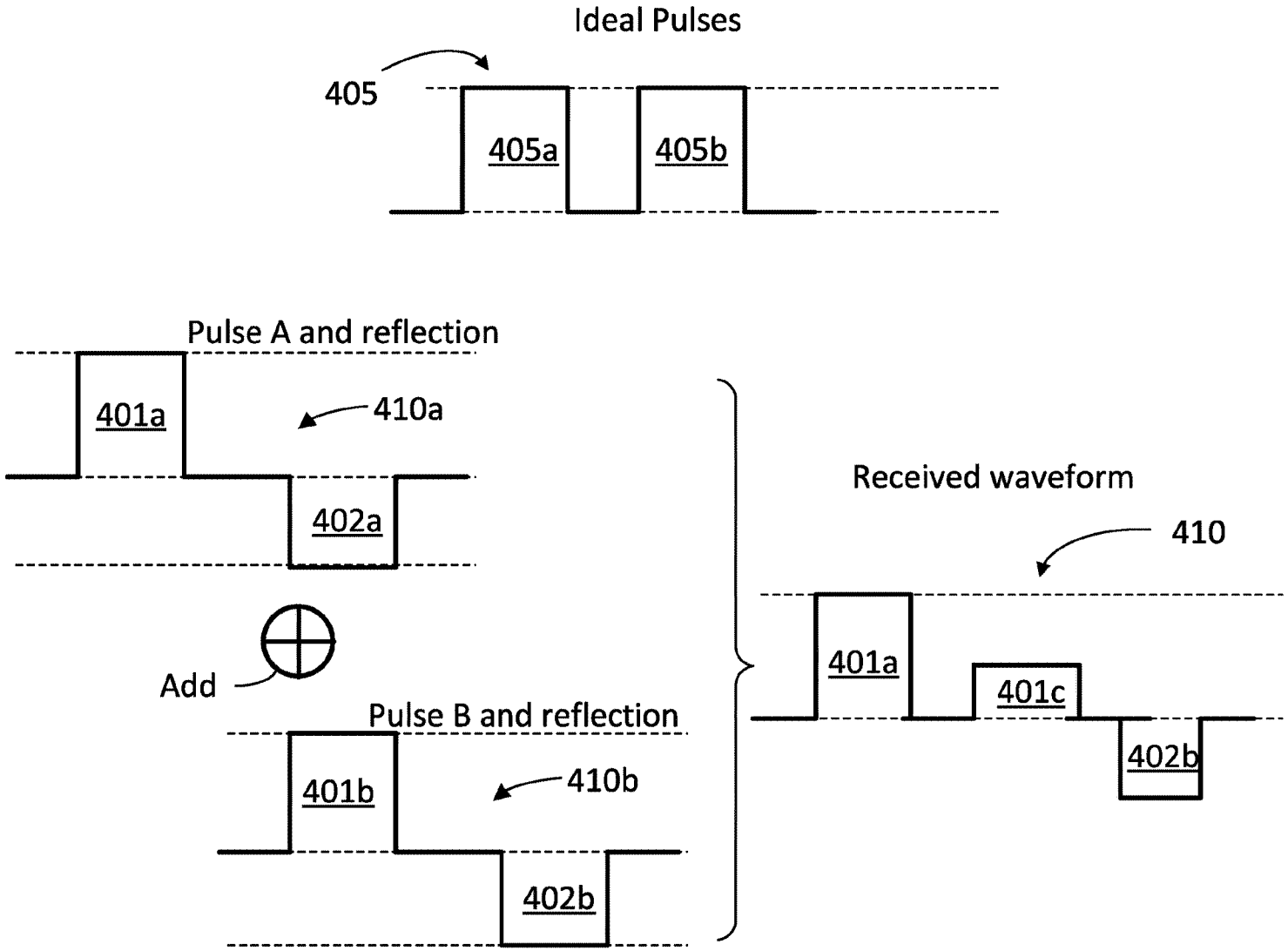
FIG. 4A illustrates the interference of reflection pulses with a sequence of two signal pulses, according to some embodiments.

FIG. 4A illustrates a pulse sequence 405 including ideal signal pulse 405*a* and ideal signal pulse 405*b* in consecutive order according to the methods disclosed herein. As mentioned above in reference to FIG. 3, ideal signal pulses 405*a* and 405*b* are shown as square waves with a flat top only for illustration purposes, and any other pulse shape may be included in embodiments consistent with the present disclosure. More generally, in some embodiments the shape of ideal pulse 405*a* may not be exactly the same as the shape of ideal pulse 405*b*. Accordingly, in some embodiments ideal pulse 405*a* is substantially similar to ideal pulse 405*b*. In general, the timing between pulses 405*a* and 405*b* may be greater, similar, or even smaller than reflection time 225 (cf. FIG. 2A). FIG. 4A illustrates the interference of waveform 410*a* ($aWav_{received}$) including ideal signal pulse 405*a* and its reflection 402*a*, with waveform 410*b* ($bWav_{received}$) including ideal signal pulse 405*b* and its reflection 402*b*, according to some embodiments. The interference results in a received waveform 410 ($Wav_{received}$) having signal pulse 401*a*, distorted pulse 401*c*, and reflection pulse 402*b*. Accordingly, distorted pulse 401*c* is the result of reflection pulse 402*a* interfering with signal pulse 401*b*. The distortion of ideal pulses 405 into received waveform 410 is believed to indicate a degraded BER due to a severe reduction of the amplitude of ideal signal pulse 405*b* by reflection pulse 402*a*. Mathematically, embodiments consistent with FIG. 4A may include the following operation:

$$Wav_{received}=a\cdot Wav_{received}+b\cdot Wav_{received} \tag{4}$$

Figure 4B:
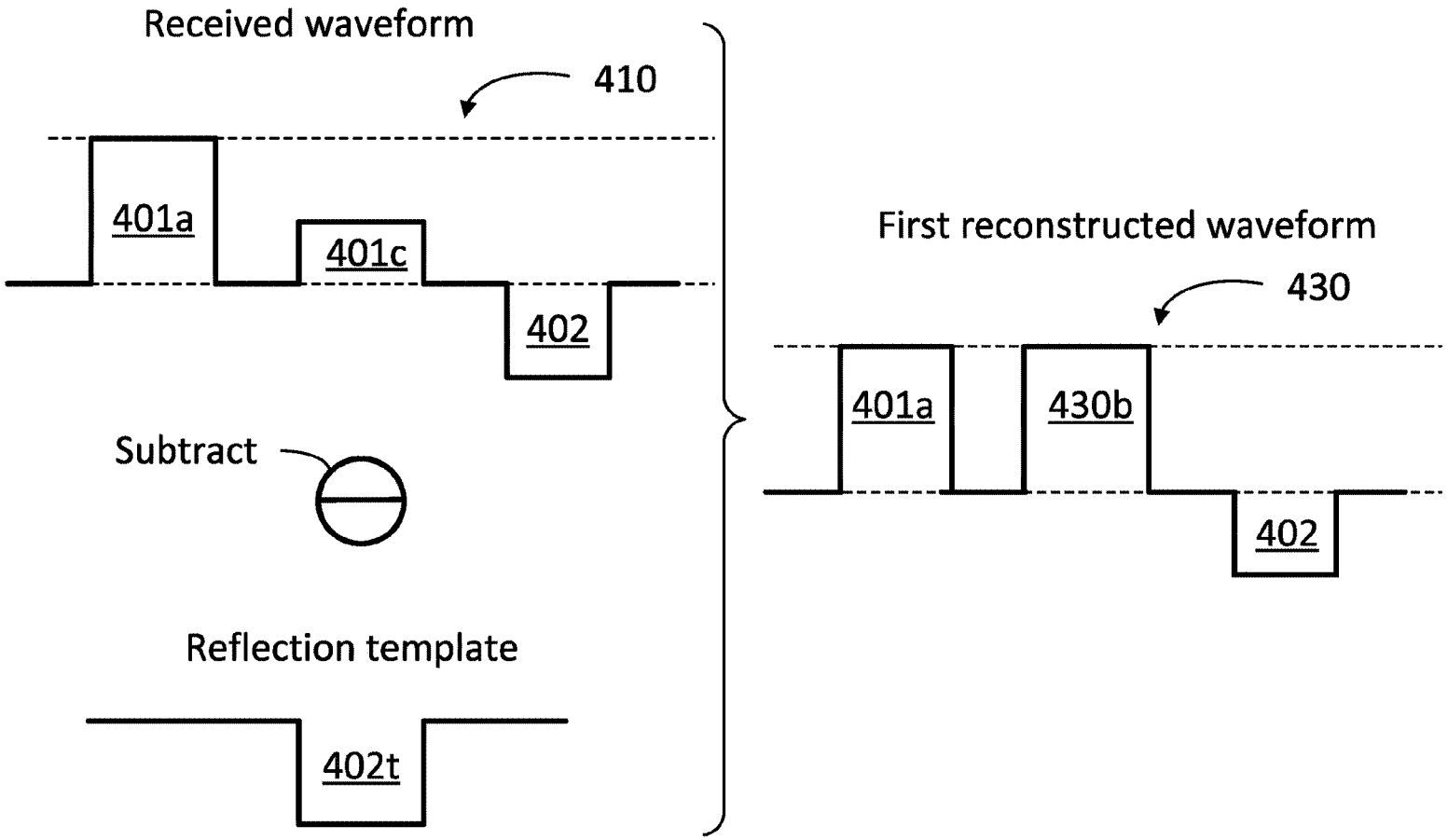
FIG. 4B illustrates a first reconstructed waveform obtained subtracting a reflection template from the received pulses in FIG. 4A, according to some embodiments.

FIG. 4B illustrates a first reconstructed waveform 430 obtained subtracting a reflection template 402*t* from received waveform 410 (cf. FIG. 4A), according to the methods disclosed herein. First reconstructed waveform 430 includes signal pulse 401*a*, signal pulse 430*b*, and reflected pulse 402. Accordingly, signal pulse 430*b* is similar to ideal signal pulse 405*b*. Thus, the BER in first reconstructed waveform 430 is believed to illustrate an improvement relative to the BER of received waveform 410 (FIG. 4A). Mathematically, embodiments consistent with FIG. 4B may include operations reflected in Eqs. 2 and 3, above.

Figure 4C:
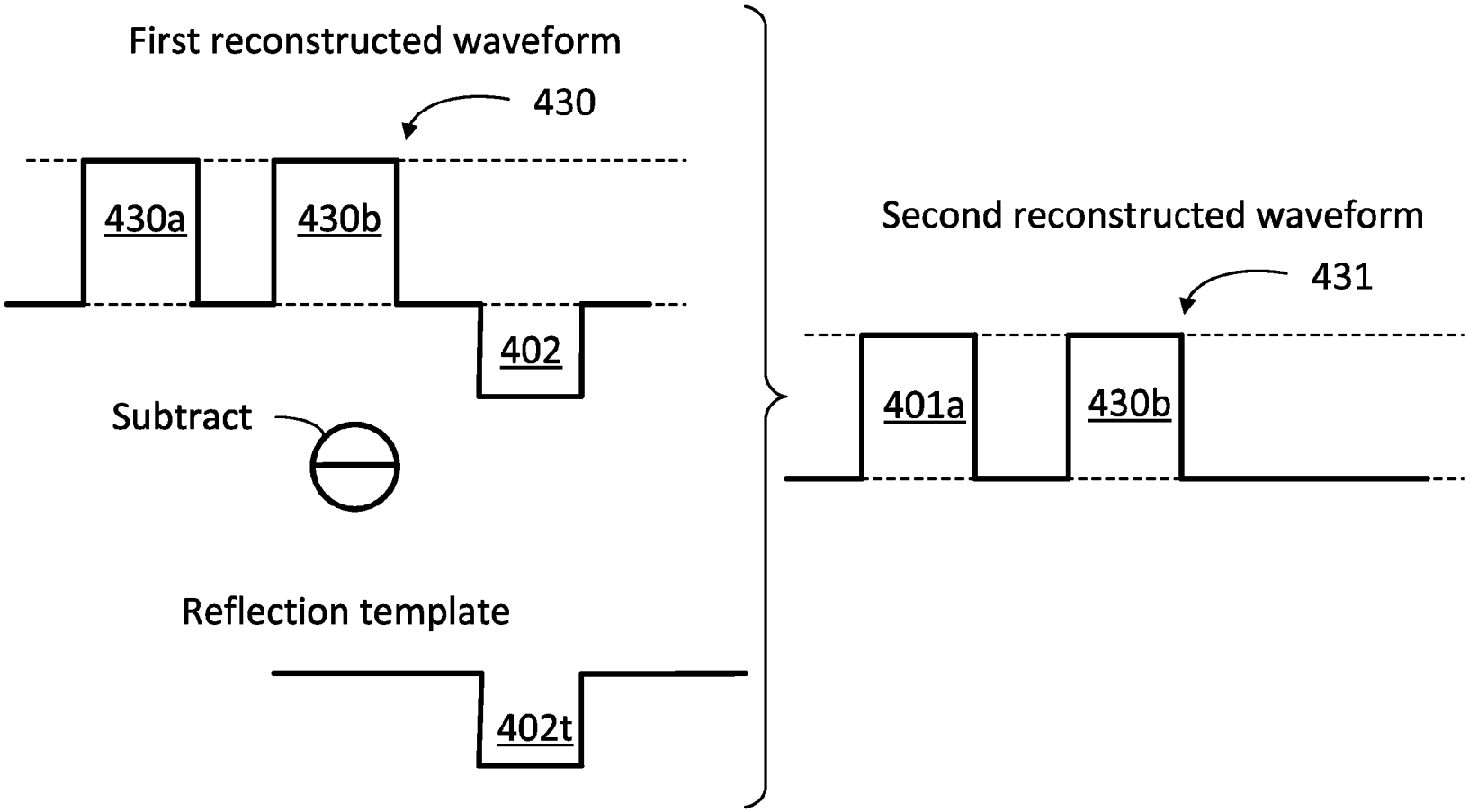
FIG. 4C illustrates a second reconstructed waveform obtained subtracting a reflection template from the first reconstructed waveform in FIG. 4B, according to some embodiments.

FIG. 4C illustrates a second reconstructed waveform 431 obtained subtracting reflection template 402*t* from first reconstructed waveform 430 (cf. FIG. 4B), according to the methods disclosed herein. Second reconstructed waveform 431 includes signal pulses 401*a*, 430*b*, and a flat trailing end without reflection pulse 402*b* (cf. FIG. 4A). Accordingly, the absence of reflection pulse 402*b* from second reconstructed waveform 431, increases the BER relative to the BER in first reconstructed waveform 430. Indeed, second reconstructed waveform 431 more closely resembles ideal signal pulses 405 (cf. FIG. 4A). Mathematically, embodiments consistent with FIG. 4C may include repeating operations reflected in Eqs. 2 and 3 after time shifting $Ref_{template}$ by an amount of time approximately equal to the delay between ideal pulse 405*a* and ideal pulse 405*b*.

Note that the time delay between the two 'ideal' signal pulses 405*a* and 405*b* in FIG. 4A is irrelevant for the reflection suppression method described in FIGS. 4A-4C. Accordingly, methods to correct for pulse distortion (e.g., pulse reflections) consistent with FIGS. 4A-4C enable reducing the MPT in data transmission schemes. Thus, embodiments consistent with the present disclosure significantly increase the amount of data transmitted to the surface by removing pulse reflections in a reduced MPT. Accordingly, embodiments consistent with the present disclosure provide more data at higher resolution (reduced distortion), in real time. Removal of the pulse reflections improves pulse detectability, increasing the reliability of the data being transmitted. In sum, embodiments consistent with the present disclosure provide increased data rates at lower SNR, as compared with state-of-the-art transmission schemes.

Figure 5:
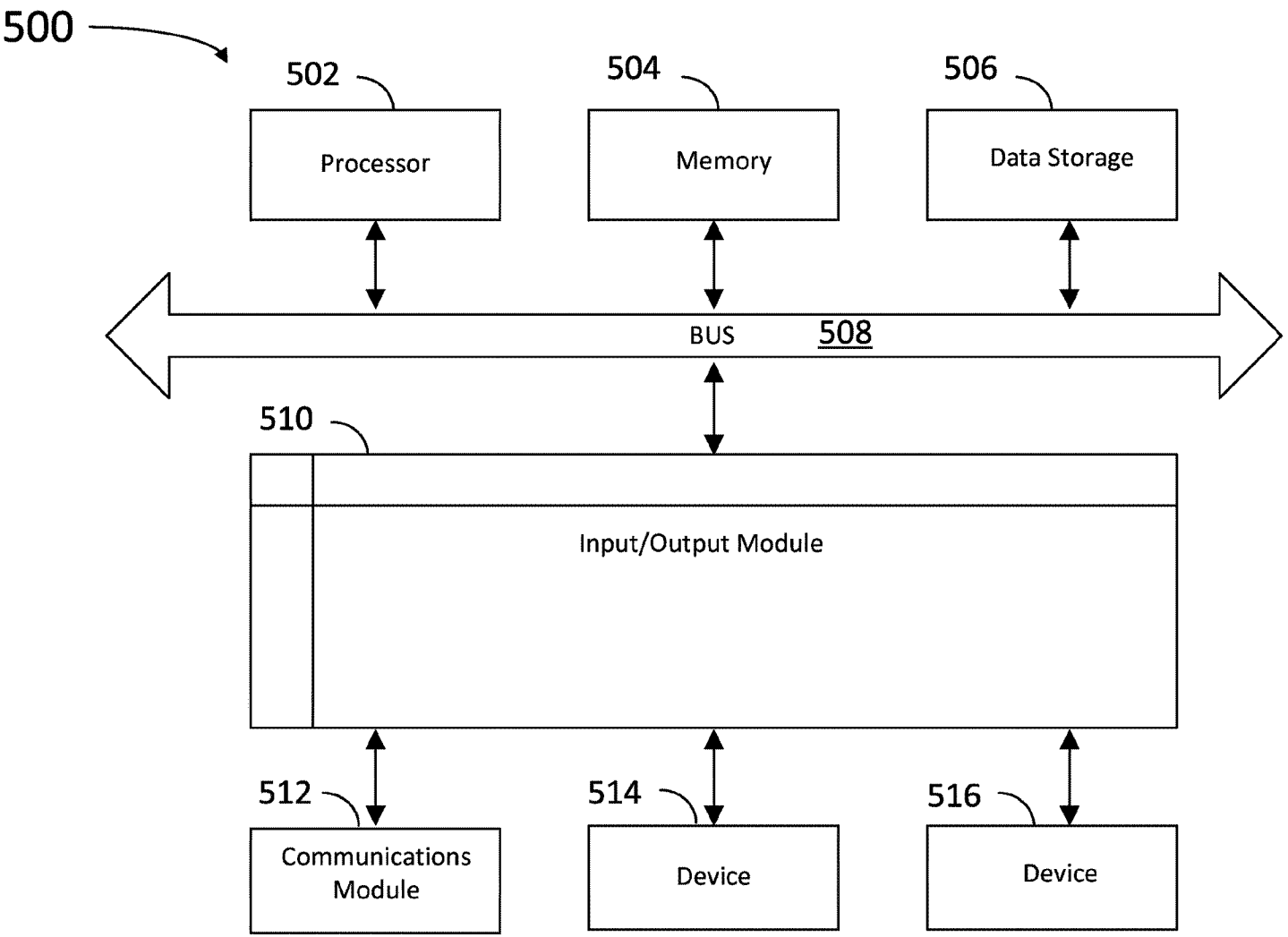
FIG. 5 illustrates a computer system configured for wave reflection suppression in a pulse sequence used for pulse modulation telemetry, according to some embodiments.

FIG. 5 illustrates a computer system 500 configured for wave reflection suppression in a pulse sequence used for pulse modulation telemetry, according to the systems and methods disclosed herein. According to one aspect of the present disclosure, computer system 500 may be included in a controller for a drilling system (e.g., controller 110 in drilling system 100, cf. FIG. 1). In some embodiments, computer system 500 includes a processor circuit 502 coupled to a bus 508 or other communication mechanism for communicating information. Bus 508 may also be coupled with other circuits in computer device 500, such as an optional memory circuit 504, an optional data storage 506, an optional input/output (I/O) module 510, an optional communications module 512, and other optional peripheral devices 514 and 516 which may include a mouse or any other pointing device, a keyboard, and a display, such as a touch-screen display. In certain aspects, computer system 500 can be implemented using hardware or a combination of software and hardware, either in a dedicated server, or integrated into another entity, or distributed across multiple entities. For example, in some embodiments computer system 500 may be remote from the site of drilling system 500, and communications module 512 includes a networking circuit coupling computer system 500 to a network that has access to controller 110.

In one embodiment, computer system 500 includes a bus 508, and a processor circuit 502 coupled with bus 508 for processing information. By way of example, computer system 500 can be implemented with one or more processor circuits 502. Processor circuit 502 can be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable entity that can perform calculations or other manipulations of information, and combinations of these.

In one embodiment, computer system 500 includes, in addition to hardware, software code that creates an execution environment for the computer program in question, e.g., code that constitutes processor firmware, a protocol stack, a database management system, an operating system, or a combination of one or more of them stored in an included memory 504, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device, coupled to bus 508 for storing information and instructions to be executed by processor 502. Processor circuit 502 and memory circuit 504 can be supplemented by, or incorporated in, special purpose logic circuitry.

The instructions may be stored in memory circuit 504 and implemented in one or more computer program products, e.g., one or more modules of computer program instructions encoded on a computer readable medium for execution by, or to control the operation of, the computer system 500, and according to any method well known to those of skill in the art, including, but not limited to, computer languages such as data-oriented languages (e.g., SQL, dBase), system languages (e.g., C, Objective-C, C++, Assembly), architectural languages (e.g., Java, .NET), and application languages (e.g., PHP, Ruby, Perl, Python). Instructions may also be implemented in any suitable computer languages including, but not limited to, array languages, aspect-oriented languages, assembly languages, authoring languages, command line interface languages, compiled languages, concurrent languages, curly-bracket languages, dataflow languages, data-structured languages, declarative languages, esoteric languages, extension languages, fourth-generation languages, functional languages, interactive mode languages, interpreted languages, iterative languages, list-based languages, little languages, logic-based languages, machine languages, macro languages, metaprogramming languages, multiparadigm languages, numerical analysis, non-English-based languages, object-oriented class-based languages, object-oriented prototype-based languages, off-side rule languages, procedural languages, reflective languages, rule-based languages, scripting languages, stack-based languages, synchronous languages, syntax handling languages, visual languages, wirth languages, embeddable languages, and xml-based languages, and any combinations of these. Memory circuit 504 may also be used for storing temporary variable or other intermediate information during execution of instructions to be executed by processor circuit 502.

A computer program as discussed herein does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, subprograms, or portions of code). A computer program can be deployed to be executed on one computer or on multiple computers that are located at one site or distributed across multiple sites and interconnected by a communication network. For example, in some embodiments the computer program may be executed by computer system 500 remotely located with respect to drilling system 100. In such instances, controller 110 may relay the telemetry signals to computer system 500 via a network connection to be processed according to methods disclosed herein. The processes and logic flows described in this specification can be performed by one or more programmable processors executing one or more computer programs to perform functions by operating on input data and generating output.

In one embodiment, computer system 500 can further include a data storage device 506, coupled to bus 508 for storing information and instructions. Suitable examples of data storage device 506 may include, but are not limited to, magnetic disks and optical disks. Computer system 500 can be coupled via input/output module 510 to various optional devices. Examples of suitable input/output modules 510 include data ports such as USB ports or other similar connecting ports. The input/output module 510 is preferably configured to connect to a communications module 512. Suitable examples of such communications modules 512 include, but are not limited to, networking interface cards, such as Ethernet cards and modems.

In some embodiments, input/output module 510 is configured to connect to a plurality of devices, such as an input device 514 and/or an output device 516. Examples of suitable input devices 514 include, but are not limited to, a keyboard, a voice receiving device, and a pointing device, e.g., a mouse or a trackball, by which a user can provide input to the computer system 500. Other kinds of input devices 514 may also be suitable to provide for interaction with a user as well, such as a tactile input device, visual input device, audio input device, or brain-computer interface device. For example, feedback provided to the user can be any form of sensory feedback, e.g., visual feedback, auditory feedback, or tactile feedback; and input from the user can be received in any form, including acoustic, speech, tactile, or brain wave input. Examples of output devices 516 include, but are not limited to, display devices, such as a LED (light emitting diode), CRT (cathode ray tube), or LCD (liquid crystal display) screen, for displaying information to the user.

In some embodiments, computer system 500 may be configured to perform steps in a method consistent with any of the methods disclosed herein in response to processor circuit 502 executing one or more sequences of one or more instructions contained in memory circuit 504. Such instructions may be read into memory circuit 504 from another machine-readable medium, such as data storage device 506. Execution of the sequences of instructions contained in main memory circuit 504 may lead to processor circuit 502 performing the process steps described herein. In some embodiments, processor circuit 502 may include one or more processors (e.g., in a multi-processing arrangement) to execute the sequences of instructions contained in memory circuit 504. In alternative aspects, hard-wired circuitry between main memory circuit 504 and process circuit 502 may be used in place of or in combination with software instructions to implement various aspects of the present disclosure.

Irrespective of FIG. 5, aspects of the present disclosure are not limited to any specific combination of hardware circuitry and software. One having ordinary skill in the art with the benefit of this disclosure can implement the hardware circuitry and software appropriate for a given well bore and well location and the desired goals of the system.

Figure 6:
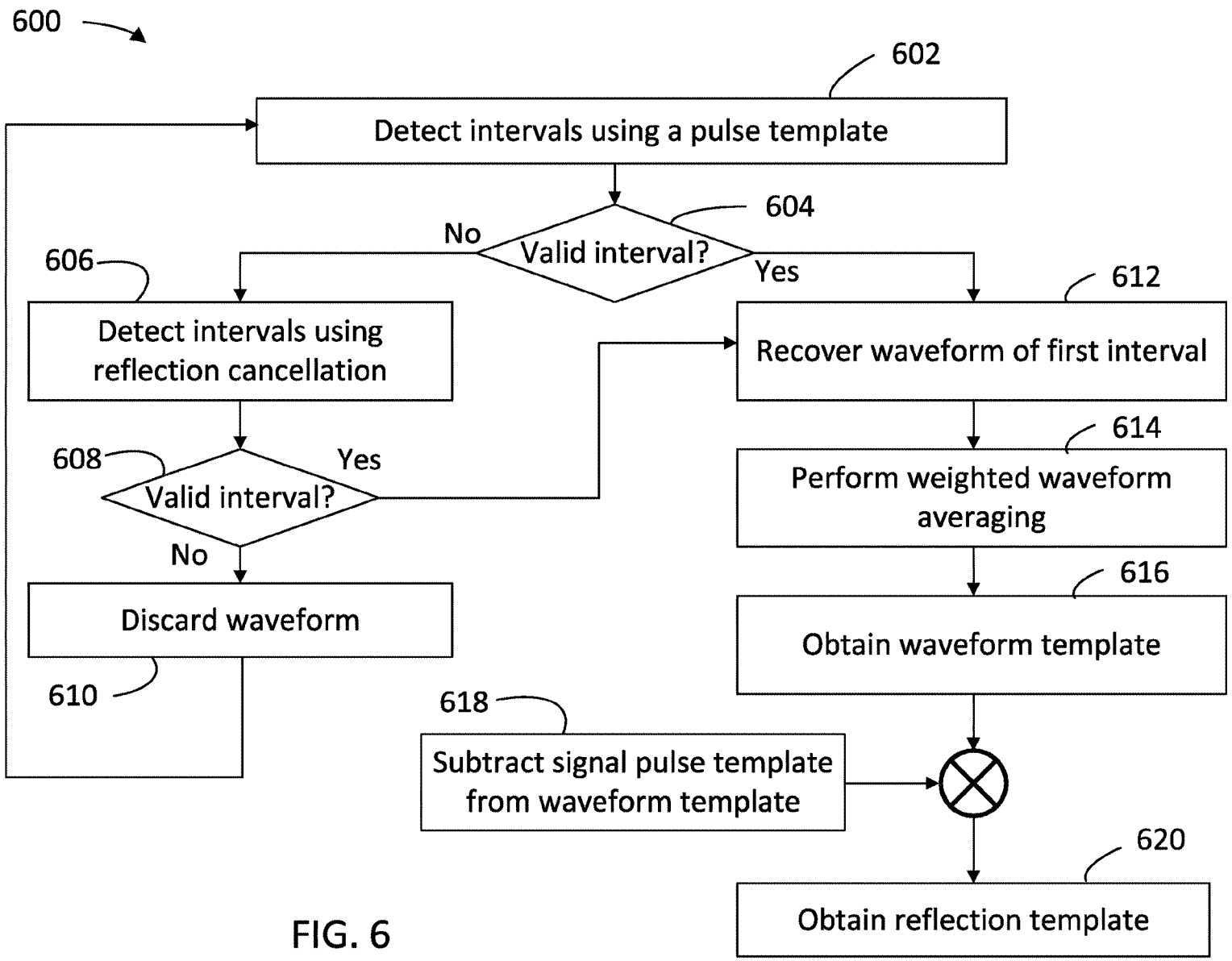
FIG. 6 illustrates a flow chart of a method for wave reflection suppression in a pulse sequence used in pulse modulation telemetry, according to some embodiments.

FIG. 6 illustrates a flow chart including steps in a method 600 for wave reflection suppression in a pulse sequence used for pulse modulation telemetry, according to and use by the systems and methods disclosed herein.

In some embodiments, method 600 includes making a decision to calculate a waveform template for wave reflection suppression (e.g., waveform template 230, cf. FIG. 2B). Methods consistent with method 600 may be performed in the context of a drilling system driving a drill tool to form a wellbore, where the drill tool includes an acoustic transducer communicating with a pressure sensor at the surface (e.g., drilling system 100, bottom hole assembly 130, pulse generator 102 and pressure sensor 101, cf. FIG. 1). Accordingly, steps in method 600 may be performed by a controller coupled to the acoustic transducer and the pressure sensor (e.g., controller 110, cf. FIG. 1). In some embodiments, steps in method 600 are at least partially performed by a computer system (e.g., computer system 500, cf. FIG. 5). The computer system performs steps in method 600 with a processor circuit configured to execute commands stored in a memory circuit (e.g., processor circuit 502, and memory circuit 504, cf. FIG. 5). The communication between the transducer and the pressure sensor may use a sequence of acoustic pulses ('pulse sequence') forming a waveform including packets of time slots where signal pulses and reflection pulses are disposed as in a digital signal scheme (e.g., pulse sequence 200, signal pulses 201, and reflection pulses 202, cf. FIG. 2A). Digital signal schemes used in methods consistent with the present disclosure include, without limitation, PPM and PWM techniques. The waveform packets may include long time interval waveforms and shorter interval waveforms (e.g., long time interval waveforms 210 and MPT interval waveforms 220, cf. FIG. 2A).

Methods consistent with method 600 may include some but not all of the steps illustrated in FIG. 6, performed in any order. Accordingly, methods consistent with the present disclosure may include at least one, two, or more of the steps in method 600 performed overlapping in time, or even simultaneously, without departing from the scope of embodiments disclosed herein. Some of the steps outlined in FIG. 6 may be skipped in some embodiments, or performed in a differing sequence than shown.

Steps in method 600 may be accomplished automatically, by computer analysis. In some embodiments, at least one or more steps in method 600 are performed by user review. For example, in some embodiments a staff operator may perform at least one of the steps in method 600 by visually inspecting a waveform trace on a computer display based on experience or an educated guess.

Step 602 includes detecting intervals in a received pulse sequence using a pulse template. Detecting intervals involves detecting a waveform or a portion of a waveform that repeats itself at least once, in the pulse sequence. In some embodiments, the first interval in a waveform packet is longer than the remaining intervals in a packet and will likely have the reflection occur before the next pulse occurs. In some embodiments, step 602 may be performed manually by a user receiving the waveforms and analyzing the waveforms on a device monitor (e.g., a computer display in output devices 516, or an oscilloscope display, or a pulse receiver display). Step 604 includes determining whether a detected interval is valid. The determination of whether an interval is valid involves finding that a single pulse signal and a single reflection signal are included in the detected interval. In some embodiments, step 604 may include determining that the detected interval is a long interval at the start of a signal packet. Moreover, in some embodiments step 604 may include determining that the detected interval includes only a signal pulse and its reflection. In that regard, the validity of the intervals detected in step 602 and validated in step 604 may not depend solely on the length of the interval, but on whether or not a signal pulse and a reflected pulse are clearly identifiable within the interval. In some embodiments, step 604 may include performing a checksum for the bits included in the packet associated with the interval detected in step 602. For example, a total number of pulses observed may indicate that the detected first interval is indeed a first interval in a data packet.

When the detected intervals using just the pulse template are determined to not be valid intervals according to step 604, proceeding to step 606 is likely advisable, which involves detecting intervals using reflection suppression, as described above. In some embodiments, step 606 includes performing a reflection cancellation method on a waveform extracted from the pulse sequence (cf. FIGS. 3 and 4). In that regard, some embodiments include having a reflection template stored in the memory circuit in order to perform step 606.

Optional step 608 includes determining whether the interval detected according to step 606 is valid. When a valid interval is not found according to step 608, the waveform including the received pulse sequence is discarded per 610 (Discard waveform). Accordingly, some embodiments include repeating method 600 from step 602, using a newly received pulse sequence until a valid interval is identified.

When a valid interval is found according to step 608 or according to step 604, step 612 includes recovering a waveform from the detected interval. The waveform in step 612 is a temporal trace of values associated to a sensor measurement, as described above. In some embodiments, step 612 may be performed using a suitably triggered data acquisition algorithm incorporated in the computer system. The data acquisition algorithm may be configured to collect signal data including the waveform in the detected interval, once the validity of the interval has been determined in step 604.

Step 614 includes performing a weighted averaging of this waveform with a stored signal and reflection templates (e.g., waveform template 230, cf. FIG. 2B). In some embodiments, the weighted average may include applying a weighting factor for the averaged waveforms according to the time when they were received by the pressure sensor. Thus, for example, the most recent waveform may be associated with a higher weighting factor, and the oldest waveform in memory may be associated with the lowest weighting factor. In that regard, step 614 may include performing mathematical operations detailed in Eq. 2, above. In this manner, methods as disclosed herein may be adapted to inherent time-changes in the received signal. For example, in some embodiments the signal may change as a drilling tool progresses down the wellbore. Moreover, in some embodiments the pump operation may change (e.g., pump speed, capacity), thereby altering the specific shape of a reflected waveform, and the distance separation between the signal pulse and its reflection in a given waveform.

In some embodiments step 614 includes performing a weighted average wherein a 50% weight is given to the most recent waveform, Wav(n), and a 50% weighting factor is given to a previous waveform template (e.g., waveform template 230, cf FIG. 2B) $Wav_{template}(n-1)$, where the integer 'n' indicates the most recently collected waveform. Mathematically, embodiments consistent with step 614 may include the following operation:

$$Wav_{template}(n) = \frac{1}{2} \cdot Wav(n) + \frac{1}{2} \cdot Wav_{template}(n-1) \tag{5}$$

In some configurations, a buffer in the memory circuit may only store two templates at a time. One of ordinary skill will recognize that the percentages used for weighting factors in step 614 may be adjusted according to drilling conditions, without limitation. In some embodiments, step 614 may include setting a cutoff for the number of waveforms to be considered in the time-average to create the reflection template. For example, some embodiments may include a fixed number of waveforms temporarily buffered in the memory, each waveform having a weighting factor that is lower for older waveforms.

Step 616 includes obtaining the waveform template including the signal pulse and the reflection pulse, as defined above (cf. FIGS. 2A-2B). Step 618 includes subtracting the signal pulse template ($Sig_{template}$) from the waveform template ($Wav_{template}$). The result is then a reflection template ($Ref_{template}$) that closely resembles a reflected signal pulse that may therefore be used to correct upcoming waveforms in the data transmission. Mathematically, embodiments consistent with method 600 may include the following operation in step 618:

$$Ref_{template} = Wav_{template} - Sig_{template} \tag{6}$$

Step 620 includes retrieving the reflection template, which contains only the reflection pulse. For example, step 620 may include storing the result of Eq. 6 in the memory of the computer system performing method 600.

Figure 7:
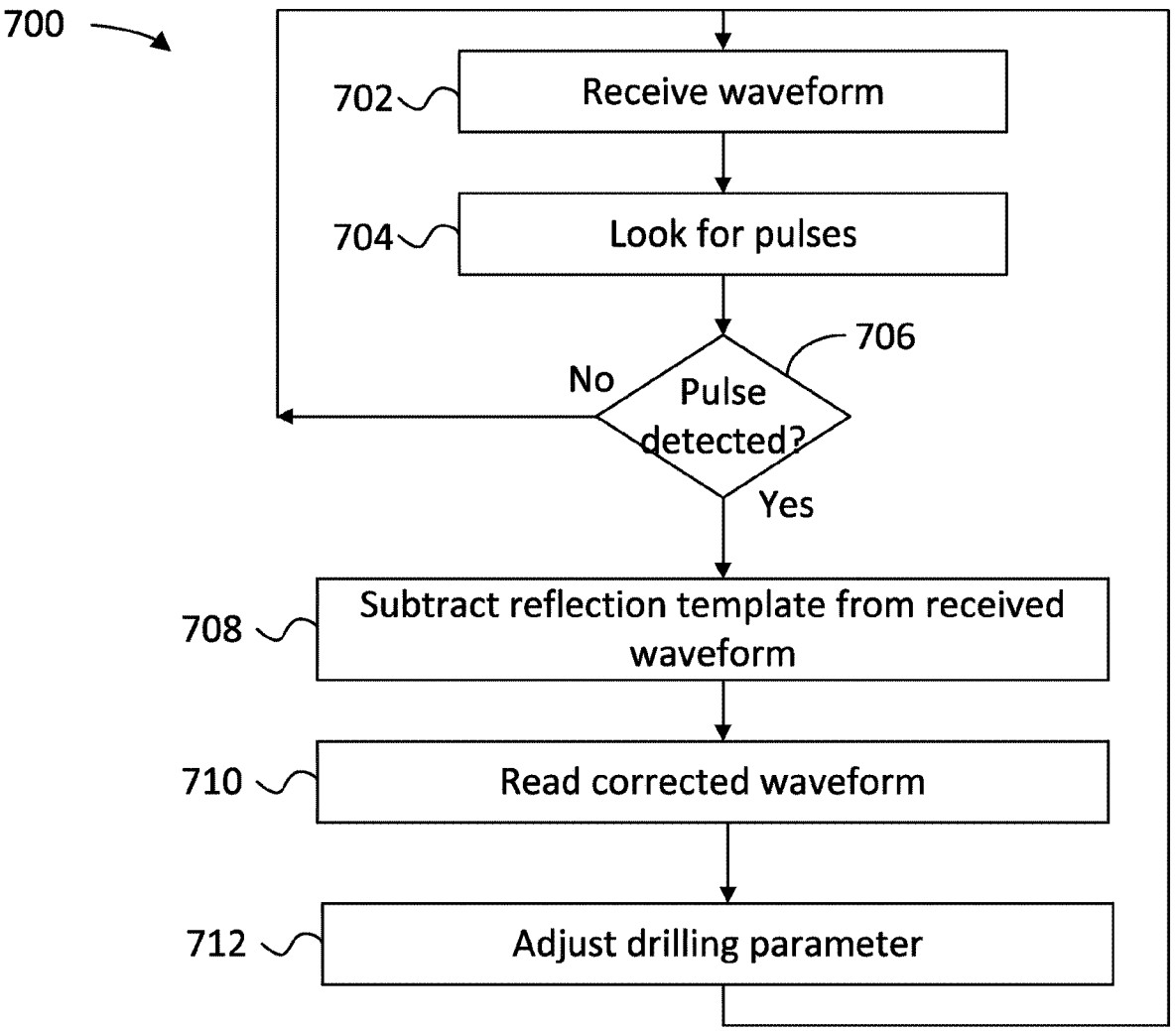
FIG. 7 illustrates a flow chart of a method for wave reflection suppression in a pulse sequence used for pulse modulation telemetry using a reflection template, according to some embodiments.

FIG. 7 illustrates a flow chart including steps in a method 700 for wave reflection suppression in a pulse sequence used in pulse modulation telemetry using a reflection template, according to the disclosure herein.

In some embodiments, method 700 may be performed in the context of method 600. More specifically, in some embodiments steps in method 700 are performed using a reflection template obtained in step 620 of method 600 (e.g., reflection template 202*t*, cf. FIG. 2B). In some embodiments, steps in method 700 may be performed in the context of step 606 in method 600 (cf. FIG. 6). Methods consistent with method 700 may be performed in the context of a drilling system driving a drill tool to form a wellbore, where the drill tool includes pulse generator communicating with a pressure sensor at the surface (e.g., drilling system 100, bottom hole assembly 130, pulse generator 102 and pressure sensor 101, cf. FIG. 1). Accordingly, steps in method 700 may be performed by a controller coupled to the pulse generator and the pressure sensor (e.g., controller 110, cf. FIG. 1). In some embodiments, steps in method 700 are at least partially performed by a computer system in the controller (e.g., computer system 500, cf. FIG. 5). The computer system performs steps in method 700 with a processor circuit configured to execute commands stored in a memory circuit (e.g., processor circuit 502, and memory circuit 504, cf. FIG. 5). The communication between the pulse generator and the pressure sensor may use a sequence of acoustic pulses ('pulse sequence') forming a waveform including packets of time slots where signal pulses and reflection pulses are disposed as in a digital signal scheme (e.g., pulse sequence 200, signal pulses 201, and reflection pulses 202, cf. FIG. 2A). Digital processing techniques used in methods consistent with the present disclosure include PPM, DPPM, PWM schemes and any of their variants. The waveform packets may include long time interval waveforms and MPT interval waveforms (e.g., long time interval waveforms 210 and MPT interval waveforms 220, cf. FIG. 2A). An MPT interval 220 includes the shortest time interval in any given waveform packet. Accordingly, a waveform packet can include any number of possible interval durations from one MPT interval 220 up to 16 interval durations, 18 interval durations, or even more.

Methods consistent with method 700 may include some but not all of the steps illustrated in FIG. 7, performed in any order. In some embodiments, steps may be deleted if needed. Accordingly, methods consistent with the present disclosure may include at least one, two, or more of the steps in method 700 performed overlapping in time, or even simultaneously, without departing from the scope of embodiments disclosed herein.

Step 702 includes receiving a waveform having the pulse sequence. In some embodiments, the waveform may include signal pulses and reflection pulses having inter-symbol interference (ISI) or multi-path interference. The ISI may be the result of a pulse reflection causing distortion of subsequent pulses. Step 704 includes looking for the pulses within the waveform. Step 706 includes determining whether a pulse has been detected (e.g., by a peak-detection processing algorithm in the computer system, or a user of the computer system looking at a display of the waveform). In some embodiments, step 706 may further include determining whether the detected pulse is a signal pulse or a reflection pulse. When a pulse is detected according to step 706, step 708 includes subtracting the reflection template from the waveform. In some embodiments, step 708 includes synchronizing the received waveform and the reflection template to form a time offset between the signal pulse and the reflection template, prior to subtracting the reflection template from the waveform. Further, in some embodiments step 708 includes forming a time offset between the signal pulse and the reflection template approximately equal to a reflection time (e.g., reflection time 225, cf. FIG. 2A).

When a reflection pulse distorts a signal pulse subsequent to the detected pulse, step 708 includes reconstructing the subsequent signal pulse. Step 710 includes reading the corrected waveform before start method 700 again, looking for more pulses. Accordingly, step 710 may include associating a value for a symbol to the signal pulse in the corrected waveform, according to any one of a digital signal schemes such as PPM or PWM. Step 712 includes adjusting a drilling parameter according to the reading of the corrected waveform. In some embodiments, step 712 may include simply decoding data sent from the downhole tools and logging the information accordingly, without modifying or adjusting the drilling parameters.

Methods consistent with the present disclosure may be applied when the reflected pulse partially overlaps with the subsequent signal pulse. Methods as disclosed herein may be applied even for a complete overlap between the reflected pulse and the subsequent signal pulse (e.g., when the reflected pulse is the same sign as the original pulse. More generally, methods consistent with the present disclosure may be applied regardless of the specific form and shape of the reflected pulses.

It is recognized that the various embodiments herein directed to computer control and artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMs, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Embodiments disclosed herein include:

A. A method that includes receiving a waveform comprising a sequence of acoustic pulses generated by a pulse generator, identifying the presence of a pulse in the waveform, the pulse at least partially encoding a symbol in a message transmitted between the pulse generator and a pressure sensor in a drill system, subtracting a reflection template from the received waveform when a pulse is present in the waveform to obtain a corrected waveform, the reflection template associated with a prototype reflection pulse in the drill system, reading the corrected waveform using a digital signal scheme for decoding the symbol in the message transmitted, and adjusting a drilling parameter in a drill system.

B. A device that includes a memory circuit storing commands, a processor circuit configured to execute the commands and cause the device to receive a waveform comprising a sequence of acoustic pulses generated by an acoustic transducer, identify the presence of a pulse in the received waveform, the pulse at least partially encoding a symbol in a message transmitted between the acoustic transducer and a pressure sensor in a drill system, subtract a reflection template from the received waveform when a pulse is present in the waveform to obtain a corrected waveform, the reflection template associated with a prototype reflection pulse in the drill system, read the corrected waveform, and send a command for a drill tool to adjust a drilling parameter based on the reading of the corrected waveform.

C. A method that includes identifying intervals in a received waveform using a pulse template, the received waveform comprising a sequence of acoustic pulses generated by a pulse generator, identifying a valid interval in the received waveform, performing a weighted average summing a plurality of received waveforms, each received waveform associated to a weight coefficient, obtaining a waveform template from the weighted average, obtaining a reflection template from the waveform template, reading a pulse sequence from a pulse generator using the reflection template, and modifying a drilling parameter in a wellbore based on the reading of the pulse sequence.

Each of embodiments A, B, and C may have one or more of the following additional elements in any combination: Element 1: wherein determining the presence of a pulse in the waveform comprises determining the presence of a signal pulse in the waveform. Element 2: wherein subtracting a reflection template from the received waveform comprises synchronizing a signal pulse in the received waveform with the reflection template to form a time offset between the signal pulse and the reflection template. Element 3: wherein synchronizing a signal pulse in the received waveform with the reflection template to form the time offset comprises forming a time offset substantially equal to a reflection time separating a signal pulse from a reflection pulse in the received waveform. Element 4: wherein adjusting a drilling parameter according to the reading comprises one of increasing, decreasing, or stopping an operation of a drill tool. Element 5: wherein adjusting a drilling parameter according to the reading comprises adjusting a characteristic of a mud flow in a wellbore formed by the drill tool. Element 6: wherein adjusting the drilling parameter comprises at least one of changing a direction of drilling and changing the behavior of any one of a plurality of downhole tools included in a bottom hole assembly of the drill system. Element 7: further comprising forming the reflection template by a weighted average of a plurality of received waveforms. Element 8: wherein reading the corrected waveform using a digital signal scheme comprises associating a value to a signal pulse in the corrected waveform based on one of a position of the signal pulse in the corrected waveform or a number of consecutive signal pulses in the corrected waveform. Element 9: further comprising subtracting the reflection template from the corrected waveform to form a doubly corrected waveform, and reading a second signal pulse in the doubly corrected waveform.

Element 10: wherein the command for a drill tool to adjust a drilling parameter further comprises steering the drill tool in a different drilling direction. Element 11: wherein to subtract a reflection template from the received waveform comprises to subtract the reflection template from the corrected waveform to obtain at least two consecutive signal pulses from the received waveform. Element 12: wherein to identify the presence of a pulse in the waveform comprises comparing the received waveform with a waveform template. Element 13: wherein the waveform template comprises a weighted average of a plurality of selected waveform intervals. Element 14: wherein the weighted average prioritizes the most recent waveform intervals.

Element 15: wherein obtaining a reflection template from the waveform template comprises subtracting a pulse template from the waveform template. Element 16: wherein reading a pulse sequence from an acoustic transducer using the reflection template comprises subtracting the reflection template for a first signal pulse identified in the pulse sequence. Element 17: wherein reading a pulse sequence from an acoustic transducer using the reflection template comprises subtracting a time-offset reflection template for each signal pulse in consecutive order. Element 18: wherein reading a pulse sequence from an acoustic transducer comprises de-codifying the pulse sequence using a digital signal processing technique. Element 19: wherein modifying the drilling parameter in a wellbore comprises modifying a mud flow with a pump. Element 20: wherein modifying the drilling parameter in a wellbore comprises one of increasing, decreasing, or stopping an operation of a drill tool. Element 21: wherein modifying the drilling parameter comprises at least one of changing a direction of drilling and changing the behavior of any one of a plurality of downhole tools included in a bottom hole assembly of the drill system.

By way of non-limiting example, exemplary combinations applicable to A, B, and C include: Element 2 with Element 3; and Element 13 with Element 14.

The exemplary embodiments described herein are well adapted to attain the ends and advantages mentioned as well as those that are inherent therein. The particular embodiments disclosed above are illustrative only, as the exemplary embodiments described herein may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

receiving a first waveform from a downhole tool via mud pulse telemetry;

identifying valid intervals from intervals in the first waveform, wherein identifying the valid intervals comprises identifying those of the intervals comprising a signal pulse and a reflection pulse associated with the signal pulse;

generating a waveform template based on a weighted average of the valid intervals;

subtracting a signal pulse template from the waveform template to obtain a reflection template that is associated with the reflection pulse;

subtracting the reflection template from a second waveform when the signal pulse is present in the second waveform to generate a corrected waveform; and decoding one or more symbols of a message from the corrected waveform.

2. The method of claim 1, wherein subtracting the reflection template from the second waveform comprises synchronizing the signal pulse in the second waveform with the reflection template to form a time offset between the signal pulse and the reflection template.

3. The method of claim 2, wherein synchronizing the signal pulse in the second waveform with the reflection template to form the time offset comprises forming the time offset substantially equal to a reflection time separating the signal pulse from a reflection pulse in the second waveform.

4. The method of claim 1 further comprising adjusting a drilling parameter in a drill system based in part on the message.

5. The method of claim 4, wherein adjusting the drilling parameter comprises at least one of changing a direction of drilling or changing behavior of any one of a plurality of downhole tools included in a bottom hole assembly of the drill system.

6. The method of claim 1 further comprising, detecting the corrected waveform using a digital signal scheme, wherein detecting the corrected waveform using a digital signal scheme comprises associating a value to the signal pulse in the corrected waveform based on one of a position of the signal pulse in the corrected waveform or a number of consecutive signal pulses in the corrected waveform.

7. The method of claim 1, further comprising:

subtracting the reflection template from the corrected waveform to form a doubly corrected waveform.

8. The method of claim 1, wherein the second waveform from which the reflection template is subtracted comprises a signal pulse partially overlapped with the reflection pulse.

9. A device, comprising: a memory circuit storing commands; a processor circuit configured to execute the commands and cause the device to:

receive a first waveform from a downhole tool via mud pulse telemetry;

identify valid intervals from intervals in the first waveform, wherein to identify the valid intervals comprises identifying those of the intervals comprising a signal pulse and a reflection pulse associated with the signal pulse;

generate a waveform template based on a weighted average of the valid intervals;

subtract a signal pulse template from the waveform template to obtain a reflection template that is associated with the reflection pulse;

subtract the reflection template from a second waveform when the signal pulse is present in the second waveform to generate a corrected waveform; and decode a set of one or more symbols of a message from the corrected waveform.

10. The device of claim 9, wherein the commands further comprise a command to send a command to adjust a drilling parameter based at least in part on the message.

11. The device of claim 10, wherein the command to adjust the drilling parameter comprises the command to steer a drill tool in a different direction.

12. The device of claim 9, wherein the commands to subtract the reflection template from the second waveform comprises command to subtract the reflection template from the corrected waveform to obtain at least two consecutive signal pulses from the second waveform.

13. The device of claim 9, wherein the commands to identify valid intervals comprises commands to compare the second waveform with a waveform template.

14. The device of claim 13, wherein the waveform template comprises a weighted average of a plurality of selected waveform intervals.

15. The device of claim 14, wherein the weighted average prioritizes the most recent waveform intervals.

16. A method, comprising:

receiving a first waveform from a downhole tool via mud pulse telemetry;

identifying valid intervals from intervals in the first waveform, wherein identifying the valid intervals comprises identifying those of the intervals comprising a signal pulse and a reflection pulse associated with the signal pulse;

performing a weighted average summing of the valid intervals of the first waveform, wherein each of the valid intervals are associated to a weight coefficient;

generating a waveform template from the weighted average;

generating a reflection template that is associated with the reflection pulse from the waveform template by subtracting a pulse template from the waveform template;

detecting a signal pulse sequence using the reflection template by subtracting the reflection template from a second waveform when the signal pulse is present in the second waveform; and decoding a set of one or more symbols of a message from the signal pulse sequence.

17. The method of claim 16, wherein detect the pulse sequence using the reflection template comprises subtracting the reflection template to obtain a first signal pulse identified in the signal pulse sequence.

18. The method of claim 16, wherein detect the signal pulse sequence using the reflection template comprises subtracting a time-offset reflection template for each signal pulse of the signal pulse sequence in consecutive order.

19. The method of claim 16, wherein detect the pulse sequence comprises de-codifying the signal pulse sequence using a digital signal processing technique.

20. The method of claim 16, further comprising modifying a drilling parameter in a wellbore based at least in part on the message, wherein modifying the drilling parameter comprises at least one of changing a direction of drilling or changing behavior of any one of a plurality of downhole tools included in a bottom hole assembly of a drill system.

* * * * *